US005295057A

United States Patent [19]

Buonsante et al.

[11] Patent Number: 5,295,057

[45] Date of Patent: Mar. 15, 1994

[54] LIGHT ON A STICK

[76] Inventors: John J. Buonsante, 17 New Haven St., Harrison, N.Y. 10528; George Spector, 233 Broadway Rm 702, New York, N.Y. 10279

[21] Appl. No.: 991,424

[22] Filed: Dec. 16, 1992

[51] Int. Cl.[5] ..... F21S 1/10

[52] U.S. Cl. ..... 362/431; 362/396

[58] Field of Search ..... 362/431, 396, 404, 413, 362/410, 382

[56] References Cited

U.S. PATENT DOCUMENTS 2,465,414 3/1949 Abshire ..... 362/396
2,793,286 5/1957 Stiffel ..... 362/431
3,072,784 1/1963 Mann ..... 362/431
3,197,631 7/1965 Jensen ..... 362/431

*Primary Examiner*—James C. Yeung

[57] ABSTRACT

A utility pole lamp is provided which consists of a plurality of elongated sections telescopically joined together to form a single adjustable vertical support shaft, so that the length of the shaft can be varied by adjusting the sections with respect to each other. A plurality of locking devices are each located between two of the elongated sections, so that the length of the shaft can be maintained. A lighting fixture having a lamp cage and cover is mounted to one of the elongated sections to provide illumination therefrom.

2 Claims, 1 Drawing Sheet

LIGHT ON A STICK

BACKGROUND OF THE INVENTION

The instant invention relates generally to lighting fixtures and more specifically it relates to a utility pole lamp, which provides an adjustable vertical support shaft to retain a lamp receptacle anywhere additional lighting is required.

There are available various conventional lighting fixtures which do not provide the novel improvements of the invention herein disclosed.

SUMMARY OF THE INVENTION

A primary object of the present invention is to provide a utility pole lamp that will overcome the shortcomings of the prior art devices.

Another object is to provide a utility pole lamp that contains an adjustable support shaft to retain a lighting fixture anywhere additional illumination is required.

An additional object is to provide a utility pole lamp in which the adjustable support shaft can be locked to variable heights between floor and ceiling and can also be hung from a hook knob member for storage purposes and for use in lieu of the floor and ceiling retention.

A further object is to provide a utility pole lamp that is simple and easy to use.

A still further object is to provide a utility pole lamp that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
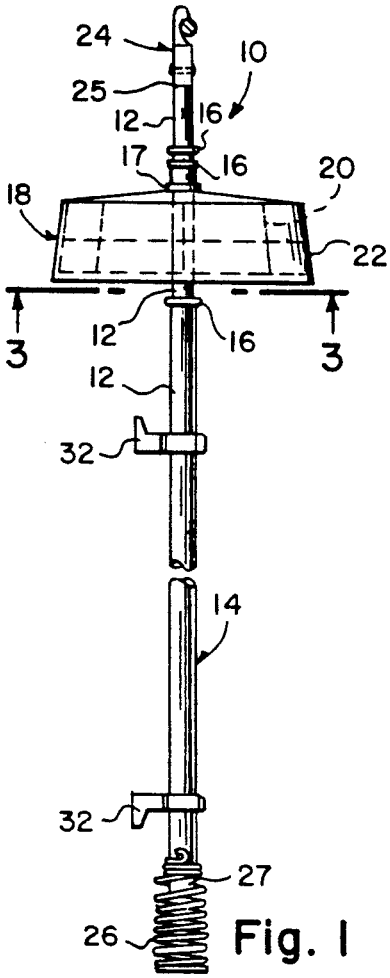
FIG. 1 is an elevational view of the invention with parts broken away and in a compressed condition.
Figure 2:
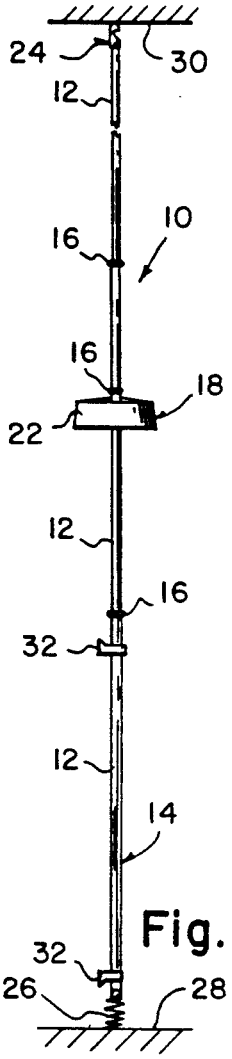
FIG. 2 is an elevational view of the invention with parts broken away and in an extended condition.

Turning now descriptively to the drawings, in which similar reference characters denote similar elements throughout the several views, the Figures illustrate a utility pole lamp 10, which consists of a plurality of elongated sections 12 telescopically joined together to form a single adjustable vertical support shaft 14, so that the length of the shaft 14 can be varied by adjusting the sections 12 with respect to each other. A plurality of locking devices 16 are also provided, with each located between two of the elongated sections 12, so that the length of the shaft 14 can be maintained. A lighting fixture 18, having a lamp cage 20 and cover 22 is retained on a section 12 at any desired location by a conventional locking device 17 to provide illumination therefrom. Any conventional locking device 16 can be used to retain sections 12 at a desired position.

A hook member 24 is secured to a top end 25 of the uppermost section 12, so that the support shaft 14 can be hung by the hook member 24. A base spring 26 is secured to a bottom end 27 of the lowermost section 12, so that the support shaft 14 can be suspended between a floor 28 and a ceiling 30 by the hook member 24 and the base spring 26.

The utility pole lamp 10 further contains a pair of cord cleats 32, spaced apart and mounted onto the lowermost section 12, so that the line cord of the lighting fixture can be wrapped about the cord cleats 32, when not in use.

Figure 4:
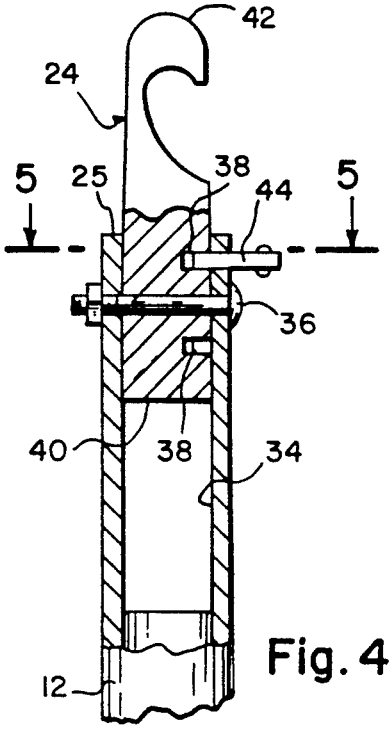
FIG. 4 is an enlarged elevational view with parts broken away and in section of a modified hook knob member which is rotatable therein.
Figure 5:
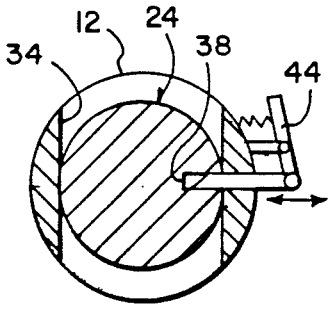
FIG. 5 is an enlarged sectional view taken along line 5—5 in FIG. 4, showing the release lever in greater detail.
Figure 3:
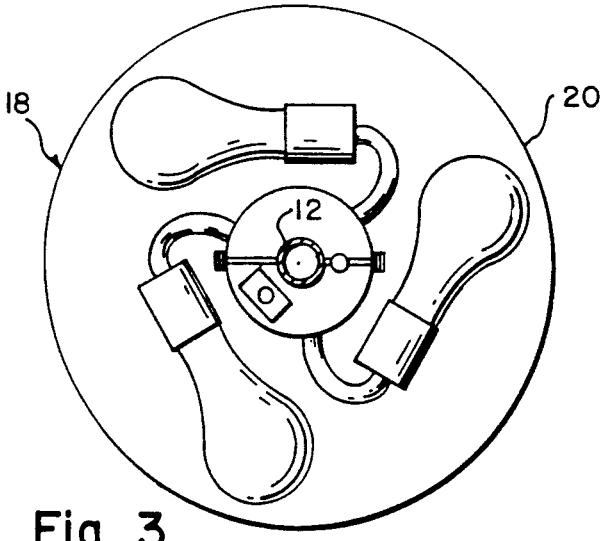
FIG. 3 is an enlarged cross sectional view taken along line 3—3 in FIG. 1, showing the lighting fixture in greater detail.

As shown in FIGS. 4 and 5, the uppermost section 12, has a slot 34 extending downwardly from the top end 25. A fastener 36 extends transversely through the uppermost section 12 at the slot 34 and through the hook member 24, so that the hook member 24 can rotate on the fastener 36 through the slot 34. The hook member 24 has two side bores 38, radially and oppositely positioned about the fastener 36, a flat bottom end 40 and a curved hook top end 42. A spring biased release lever 44 is mounted to a side of the uppermost section 12 proximate the top end 25, so as to engage within one of the side bores 38 in the hook member 24.

In a first position, the hook member 24 is retained with the curved hook top end 42 extending therefrom, so as to be hung therefrom. In second position, the hook member 24 is retained with the flat bottom end 40 extending therefrom to better contact the ceiling 80.

While certain novel features of this invention have been shown and described and are pointed out in the annexed claim, it will be understood that various omissions, substitutions and changes in the forms and details of the device illustrated and in its operation can be made by those skilled in the art without departing from the spirit of the invention.

What is claimed is:

1. A utility pole lamp comprising:

a) a plurality of elongated adjustably telescoped sections including top and bottom sections forming an adjustable support shaft;

b) a plurality of locking devices each located between adjacent sections so that a desired shaft length may be maintained; and c) a lighting fixture mounted on one of said sections;

d) a member having a hook at one end and a flat surface at an opposite end, wherein said member is pivotly mounted on said top section with means for securing said member in one position with the hook upper most and in another position with the flat surface upper most; and e) a spring secured to said bottom section.

2. A utility pole lamp which comprises:

a) a plurality of elongated sections including upper most and lower most sections telescopically joined together to form a single adjustable vertical support shaft so that the length of said shaft can be varied by adjusting said sections with respect to each other;

b) a plurality of locking devices, each located between two of said elongated sections so that the length of said shaft can be maintained; and c) a lighting fixture having a lamp cage and cover mounted to one of said elongated sections to provide illumination therefrom;

d) a hook member secured to a top end of said upper most section so that said support shaft can be hung by said hook member;

e) a base spring secured to a bottom end of said lower most section, so that said support shaft can be suspended between a floor and a ceiling by said hook member and said base spring; further including a pair of cord cleats, spaced apart and mounted onto said lower most section, so that a line cord of said lighting fixture can be wrapped about said cord cleats when not in use; further including:

f) said upper most section having a slot extending downwardly from the top end;

g) a fastener extending transversely through said upper most section at said slot and through said hook member, so that said hook member can rotate on said fastener through said slot;

h) said hook member having two sides bores radially and oppositely positioned about said fastener, a flat bottom end and a curved hook top end; and i) a spring biased release lever mounted to a side of said upper most section proximate the top end, so as to engage within one of said side bores in said hook member, whereby in a first position and hook member is retained with the curved hook top end extending therefrom, so as to be hung therefrom, and in a second position said hook member is retained with the flat bottom end extending therefrom to better contact the ceiling.

* * * * *